US010056681B2

(12) United States Patent
Schilling et al.

(10) Patent No.: US 10,056,681 B2
(45) Date of Patent: Aug. 21, 2018

(54) VEHICLE UBIQUITOUS DEDICATED SHORT RANGE COMMUNICATION ANTENNA INTEGRATION

(71) Applicant: Veoneer US Inc., Southfield, MI (US)

(72) Inventors: Robert Schilling, Londonderry, NH (US); Scott A. Nist, Hartland, MI (US)

(73) Assignee: VEONEER US INC., Southfield, MI (US)

( * ) Notice: Subject to any disclaimer, the term of this patent is extended or adjusted under 35 U.S.C. 154(b) by 0 days.

(21) Appl. No.: 15/672,561

(22) Filed: Aug. 9, 2017

(65) Prior Publication Data

US 2018/0034144 A1 Feb. 1, 2018

Related U.S. Application Data

(63) Continuation of application No. PCT/US2016/017488, filed on Feb. 11, 2016.

(60) Provisional application No. 62/115,283, filed on Feb. 12, 2015.

(51) Int. Cl.

| | |
|---|---|
| ***G08G 1/16*** | (2006.01) |
| ***H01Q 1/32*** | (2006.01) |
| ***H01Q 1/40*** | (2006.01) |

(52) U.S. Cl.

CPC ..... *H01Q 1/3283* (2013.01); *G08G 1/161* (2013.01); *H01Q 1/3233* (2013.01); *H01Q 1/40* (2013.01)

(58) Field of Classification Search

CPC ..... B60R 13/10; G09F 21/04

See application file for complete search history.

(56) References Cited

U.S. PATENT DOCUMENTS

| | | | | |
|---|---|---|---|---|
| 7,096,102 | B1 | 8/2006 | Parker, Sr. | 701/36 |
| 2007/0171077 | A1* | 7/2007 | Kawarizadeh | B60R 11/0264 340/572.8 |
| 2009/0021379 | A1 | 1/2009 | Zhu et al. | 340/572.8 |
| 2011/0078933 | A1* | 4/2011 | Lukawitz | B60Q 1/503 40/204 |
| 2011/0295697 | A1* | 12/2011 | Boston | B60Q 1/503 705/14.68 |

FOREIGN PATENT DOCUMENTS

| | | | |
|---|---|---|---|
| WO | WO 95/22132 | 8/1995 | G08G 1/017 |
| WO | WO 96/36031 | 11/1996 | G08G 1/017 |

* cited by examiner

*Primary Examiner* — Fabricio R Murillo Garcia

(74) *Attorney, Agent, or Firm* — Christopher P. Maiorana, PC

(57) ABSTRACT

An apparatus comprising a cover and an antenna circuit. The cover may be implemented as a dielectric material having one or more apertures. The antenna circuit may be configured to provide communication signals to/from a vehicle. The cover may be implemented to limit a visibility of the antenna circuit. An arrangement of the apertures of the cover is configured to allow transmission of the communication signals to/from the antenna circuit. The antenna circuit may provide a range of communication coverage in a particular direction for the vehicle.

18 Claims, 10 Drawing Sheets

VEHICLE UBIQUITOUS DEDICATED SHORT RANGE COMMUNICATION ANTENNA INTEGRATION

This application relates to International Application PCT/US2016/017488, with an International Filing Date of Feb. 11, 2016, which claims the benefit of U.S. Provisional Application No. 62/115,283, filed Feb. 12, 2015, each of which is incorporated by reference in its entirety.

FIELD OF THE INVENTION

The present invention relates to communication systems generally and, more particularly, to an apparatus for implementing a vehicle ubiquitous dedicated short range communication antenna.

BACKGROUND OF THE INVENTION

In approximately 2006, the United States Department of Transportation entered into an agreement with the Crash Avoidance Metrics Partnership (CAMP) consortium of the automotive industry to assess the feasibility of a Dedicated Short Range Communication (DSRC) system for automobiles for both Vehicle to Vehicle (V2V) and Vehicle to Infrastructure (V2I) communications. A principle focus was to share information between vehicle and interchanges with goals of reducing accidents and saving lives. The antenna portion of the feasibility investigative effort was deemed to be a risk area.

In the CAMP feasibility study, antennas were externally mounted to a roof or sideview mirrors of the vehicles. Antennas on the roof or sideview mirrors of the vehicles cause aesthetic issues. Furthermore, antennas on roofs or sideview mirrors of vehicles are not ubiquitous.

It would be desirable to implement a vehicle ubiquitous DSRC antenna integration.

SUMMARY OF THE INVENTION

The present invention concerns an apparatus comprising a cover and an antenna circuit. The cover may be implemented as a dielectric material having one or more apertures. The antenna circuit may be configured to provide communication signals to/from a vehicle. The cover may be implemented to limit a visibility of the antenna circuit. An arrangement of the apertures of the cover is configured to allow transmission of the communication signals to/from the antenna circuit. The antenna circuit may provide a range of communication coverage in a particular direction for the vehicle.

In some embodiments of the apparatus aspect described above, the apparatus is implemented as a license plate. In some embodiments implementing the apparatus as a license plate, the cover is implemented as a material of the license plate.

In some embodiments of the apparatus aspect described above, the cover is a license plate holder.

In some embodiments of the apparatus aspect described above, the communication signals to/from the vehicle implement a beacon to provide data for driver assistance. In some embodiments implementing the beacon to provide data for driver assistance, the beacon is used to determine if a nearby vehicle could potentially cause a problem. In some embodiments implementing the beacon to provide data for driver assistance, the beacon is used by another vehicle to avoid a collision. In some embodiments implementing the beacon to provide data for driver assistance, the data provided by the beacon is used to communicate with a vehicle that is not visible to a driver. In some embodiments implementing the beacon to provide data for driver assistance, the beacon is used to provide warnings to a driver.

In some embodiments of the apparatus aspect described above, the antenna circuit is attached to a backside of the cover as a separate layer using an adhesive.

In some embodiments of the apparatus aspect described above, the antenna circuit is incorporated as part of the cover.

In some embodiments of the apparatus aspect described above, one of the apparatuses is attached to a rear end of the vehicle and one of the apparatuses is attached to a front end of the vehicle to provide communication coverage for the vehicle.

In some embodiments of the apparatus aspect described above, the apparatus is configured to provide a dedicated short range communication system for the vehicle and the dedicated short range communication system implements vehicle to vehicle communications in a first mode and vehicle to infrastructure communications in a second mode.

In some embodiments of the apparatus aspect described above, the apparatus is configured as a retrofit for the vehicle.

In some embodiments of the apparatus aspect described above, the dielectric material is a plastic material and the cover is configured as a radome for the antenna circuit.

In some embodiments of the apparatus aspect described above, the range of communication coverage comprises a hemispherical communication coverage.

The present invention concerns an apparatus comprising a cover and an antenna circuit. The cover may be implemented using a dielectric material. The antenna circuit may be configured to provide communication signals to/from a vehicle. The cover may be implemented to limit a visibility of the antenna circuit. The dielectric material of the cover may be configured to allow transmission of the communication signals to/from the antenna circuit. The antenna circuit provides a range of communication coverage in a particular direction for the vehicle.

In some embodiments of the apparatus aspect described above, the dielectric material is a plastic material.

The present invention concerns an apparatus comprising a cover and an antenna circuit. The cover may be implemented using one or more apertures filled with a dielectric material. The antenna circuit may be configured to provide communication signals to/from a vehicle. The cover is implemented to limit a visibility of the antenna circuit. The dielectric material of the apertures may be implemented to allow transmission of the communication signals to/from the antenna circuit. The antenna circuit may provide a range of communication coverage in a particular direction for the vehicle.

In some embodiments of the apparatus aspect described above, a material of the cover is a metal material.

BRIEF DESCRIPTION OF THE DRAWINGS

Embodiments of the invention will be apparent from the following detailed description and the appended claims and drawings in which:

DETAILED DESCRIPTION OF THE PREFERRED EMBODIMENTS

Embodiments of the present invention include providing vehicle ubiquitous dedicated short range communication antenna that may (i) be aesthetically un-noticeable, (ii) be implemented as a retrofit for vehicles, (iii) be implemented as a license plate, (iv) provide hemispherical communication coverage for the vehicle, (v) implement an electronic control unit for communication with components of the vehicle, (vi) implement a beacon for providing information to vehicles and infrastructure and/or (vii) be easy to implement.

Worldwide, vehicles have provisions for license plates on both a front and/or rear end of the vehicle. In the US, license plates (except motorcycles) are the same size. A manufacturing method of the license plate may be changed to implement a plastic material. The plastic material may be configured as a cover. The cover may serve as a "radome" over a layer of a printed circuit antenna. The printed circuit antenna may provide better than hemispherical communication coverage for the vehicle. Alternatively, the license plate holder on the vehicle may be designed to incorporate the antenna. Coupled with a similar install on the rear, 360° coverage (or near 360° coverage) may be realized.

Figure 1:
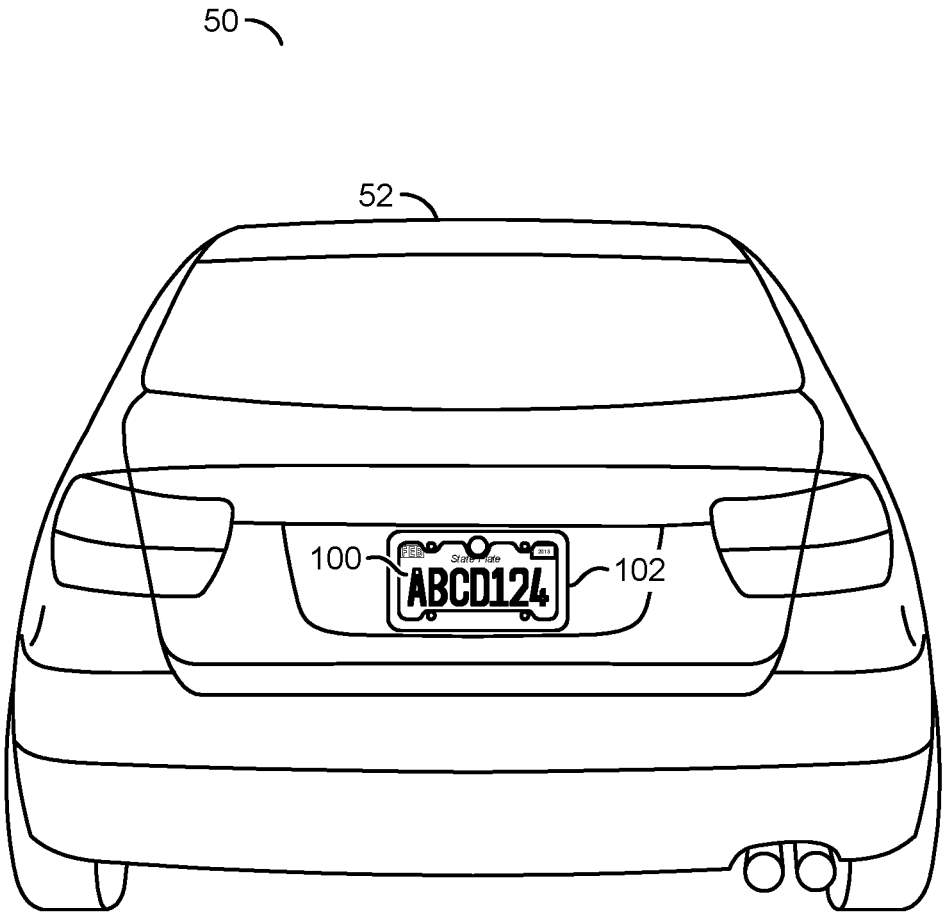
FIG. 1 is an example embodiment.

Referring to FIG. 1, an example embodiment 50 is shown. A rear view of a vehicle 52 is shown. The rear view of the vehicle 52 generally comprises a license plate 100. The license plate 100 is shown having a license plate holder 102. The license plate 100 and/or license plate holder 102 may be configured to act as a radome for communication components used to transmit beacons for vehicle to vehicle and/or vehicle to infrastructure communication. The license plate 100 and/or license plate holder 102 may allow a ubiquitous and/or unnoticeable implementation of wireless communication from the vehicle 52.

Figure 2:
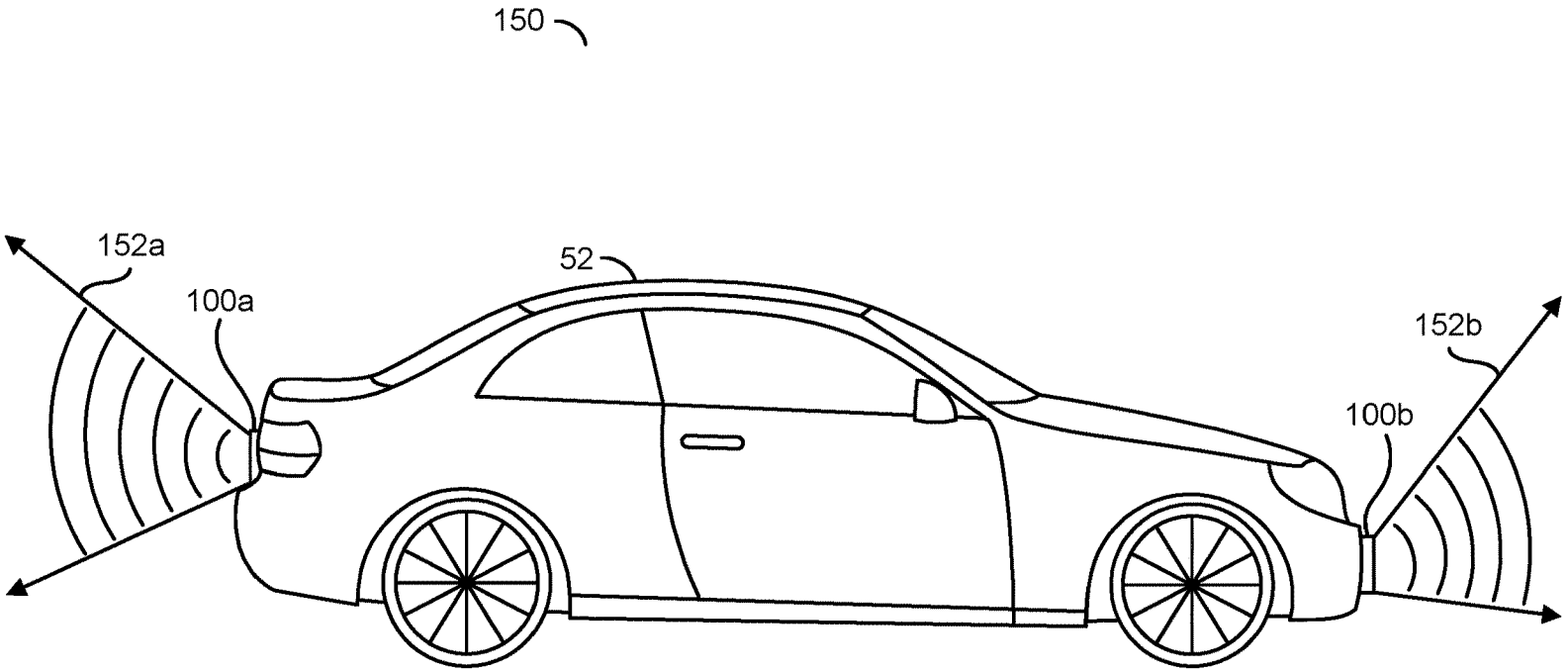
FIG. 2 is an example of communication coverage.

Referring to FIG. 2, an example communication coverage 150 is shown. The vehicle 52 is shown having two license plates 100*a*-100*b*. Each of the license plates 100*a*-100*b* may provide a range of wireless communication coverage in a particular direction for transmitting/receiving a beacon. A front end license plate 100*b* presents a forward communications coverage 152*b*. A rear end license plate 100*a* presents a rear communications coverage 152*a*.

Figure 3:
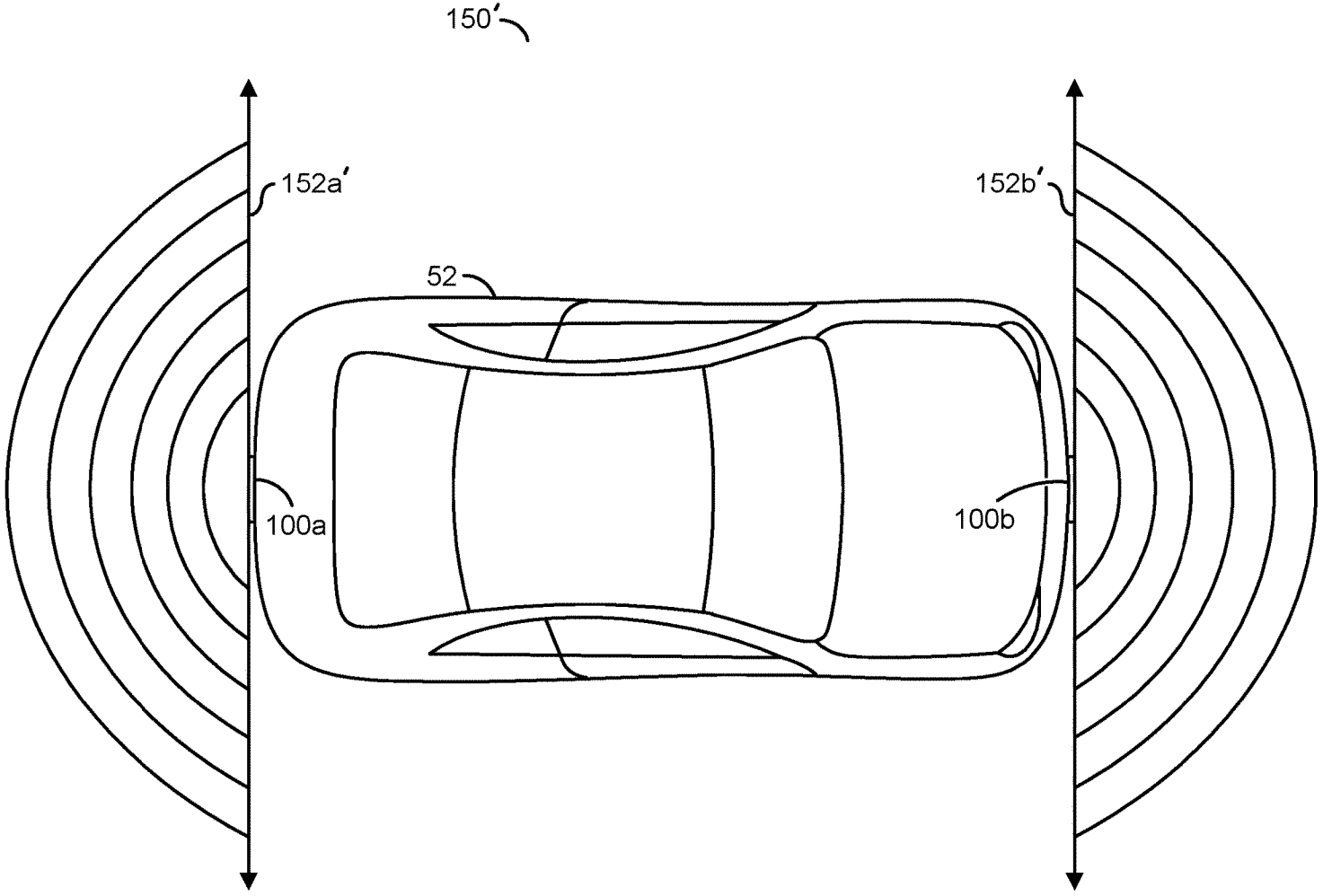
FIG. 3 is an example of a top view of communication coverage.

Referring to FIG. 3, an example of a top view of wireless communication coverage 150' is shown. The front license plate 100*b* presents the forward communications coverage 152*b*'. The rear license plate 100*a* presents the rear communications coverage 152*a*'. Both the front communication coverage 152*b*' and the rear communication coverage 152*a*' are shown having a hemispherical wireless communication coverage. For example, the front communication coverage 152*b*' and the rear communication coverage 152*a*' may each provide a 180° (or near 180°) wireless communication coverage in a respective direction. Together, the front communication coverage 152*b*' and the rear communication coverage 152*a*' may provide a 360° wireless communication coverage for the vehicle 52. The range of coverage provided by the rear license plate 100*a* (e.g., the rear communication coverage 152*a*') and/or the front license plate 100*b* (e.g., the front communication coverage 152*b*') may be varied according to the design criteria of a particular implementation.

The rear communication coverage 152*a*' and/or the front communication coverage 152*b*' may be configured to transmit the beacon. The beacon may be configured to transmit data from the vehicle 52 to other vehicles and/or infrastructure. Information provided by the beacon may be used to determine a position, velocity and/or acceleration of the vehicle 52. Other data may be transmitted by the beacon. In an example, the beacon may provide one or more of a location, an identification, a speed, a direction of travel, a destination of travel and/or information from one or more sensors (e.g., wheel-click sensor information, gyroscope information, temperature, fuel consumption, traction information, weather information, etc.) of the vehicle 52. The information transmitted by the beacon may be varied according to the design criteria of a particular implementation.

In some embodiments, the information provided by the beacon may be used for driver assistance. In an example, the driver assistance may be collision detection. In another example, the driver assistance may be automated parking. In yet another example, the driver assistance may be lane-change and/or lane-centering assistance. The type of driver assistance provided may be varied according to the design criteria of a particular implementation.

Figure 4:
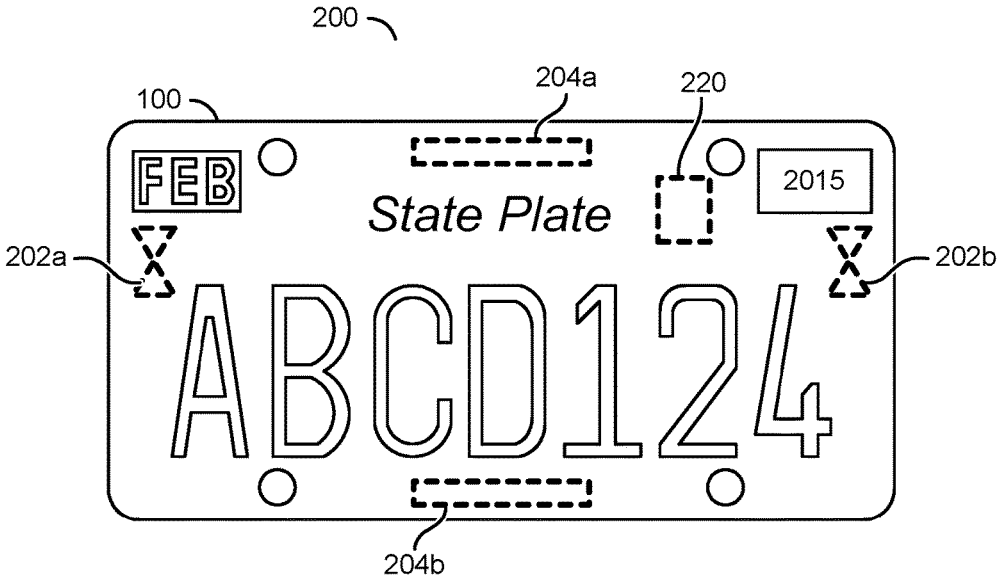
FIG. 4 is an example license plate embodiment.

Referring to FIG. 4, an example license plate embodiment 200 is shown. The license plate 100 may comprise a dielectric material. For example, the dielectric material may be a plastic material. The license plate 100 is shown having a number of antenna circuits 202*a*-202*b* and/or a number of apertures 204*a*-204*b*.

The license plate 100 is shown having a block (or circuit) 220. The circuit 220 may be an electronic control unit (ECU). The ECU 220 may be integrated as part of the license plate 100 and/or attached with an adhesive. Details of the ECU 220 will be described in more detail in connection with FIG. 11.

The antenna circuits 202*a*-202*b* may provide a range of communication coverage in a particular direction (e.g., 152*a* and/or 152*b*) for the vehicle 52. The antenna circuits 202*a*-202*b* may transmit communication signals to/from the vehicle 52. The apertures 204*a*-204*b* may be implemented as integrated dielectric apertures. The apertures 204*a*-204*b* may be arranged on the cover (e.g., the material of the license plate 100) to allow transmission of the communication signals (e.g., the beacon) to/from the antenna circuits 202*a*-202*b*. In some embodiments, the antenna circuits 202*a*-202*b* may be attached using an adhesive. The antenna circuits 202*a*-202*b* and/or the ECU 220 may not be visible from a front view of the license plate 100 (e.g., un-noticeable to an onlooker as shown in FIG. 1).

In some embodiments, the license plate 100 may implement each of the antenna circuits 202*a*-202*b* as a dipole. The dipoles 202*a*-202*b* may be implemented as a printed circuit configured to reside under the license plate 100. The license plate 100 may be implemented as a dielectric cover to allow transmission of the communication signals (e.g., beacons) out from the dipoles 202*a*-202*b* and/or reception of the communication signals in through the license plate 100. Implementing the license plate 100 as a dielectric cover may allow for the transmission/reception of the communication signals while limiting interference of the communication signals.

In some embodiments, the license plate 100 may implement the apertures 204*a*-204*b* as slots (e.g., horizontal slots, vertical slots and/or any other suitable shape for a slot). The apertures/slots 204*a*-204*b* may be implemented as dielectric-filled holes in the metal license plate 100. The antenna circuits 202*a*-202*b* may be implemented as a circuit behind the apertures/slots 204*a*-204*b* to excite the slot. The antenna circuits 202*a*-202*b* may be pieces of conductor and/or holes in conductors. The antenna circuits 202*a*-202*b* may be configured to transmit the communication signals out and/or receive the communication signals in through the apertures/slots 204*a*-204*b*. Using the apertures/slots 204*a*-204*b* may allow the license plate 100 to use a metal material (e.g., a conventional material used for license plates). Implementing the license plate 100 with the apertures 204*a*-204*b* may allow for the transmission/reception of the communication signals while limiting interference of the communication signals.

In some embodiments, both the dipoles 202*a*-202*b* and the apertures/slots 204*a*-204*b* may be implemented. The implementation used to allow the antenna circuits 202*a*-202*b* to transmit the communication signals and/or receive the communication signals may be varied according to the design criteria of a particular implementation.

Figure 5:
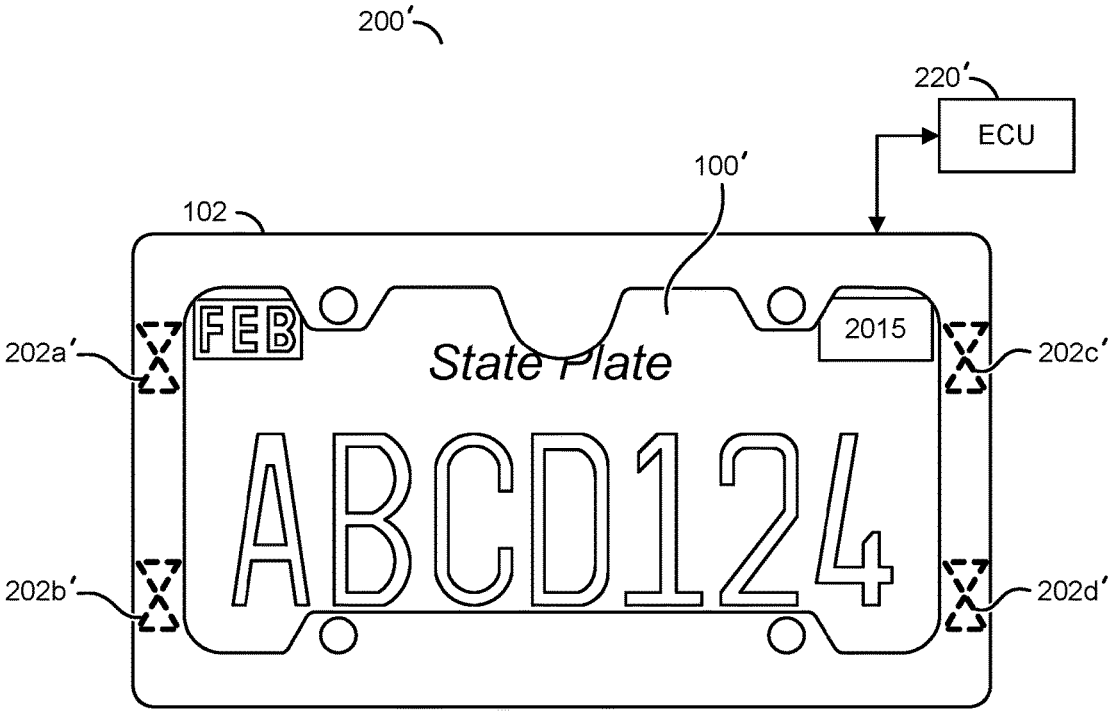
FIG. 5 is an example license plate holder embodiment.

Referring to FIG. 5, an example license plate holder embodiment 200' is shown. The license plate 100' is shown having the license plate holder 102. The license plate holder 102 may be comprised of the dielectric material. The antenna circuits 202*a*'-202*d*' are shown attached to the license plate holder 102. The license plate holder 102 may hide the antenna circuits 202*a*'-202*d*' from view. The license plate holder 102 may be the cover. The antenna circuits 202*a*'-202*d*' may be attached to the license plate holder 102 using an adhesive and/or be integrated as part of the license plate holder 102. In some embodiments, the license plate holder 102 may implement the antenna circuits 202*a*'-202*d*' as dipoles. The license plate holder 102 may be implemented as a dielectric cover to allow transmission of the communication signals out from the dipoles 202*a*'-202*d*' and/or reception of the communication signals in through the license plate holder 102.

The license plate holder embodiment 200' is shown connected to the ECU 220'. For example, the ECU 200' may be a component external to the license plate holder embodiment 200'. In some embodiments, the ECU 220' may be an internal component of the license plate holder 102 (e.g., an integrated component and/or attached using an adhesive). The ECU 220' may be connected and/or positioned to be hidden from view as shown in FIG. 1. The implementation of and/or connections to the ECU 220' may be varied according to the design criteria of a particular implementation.

Figure 6:
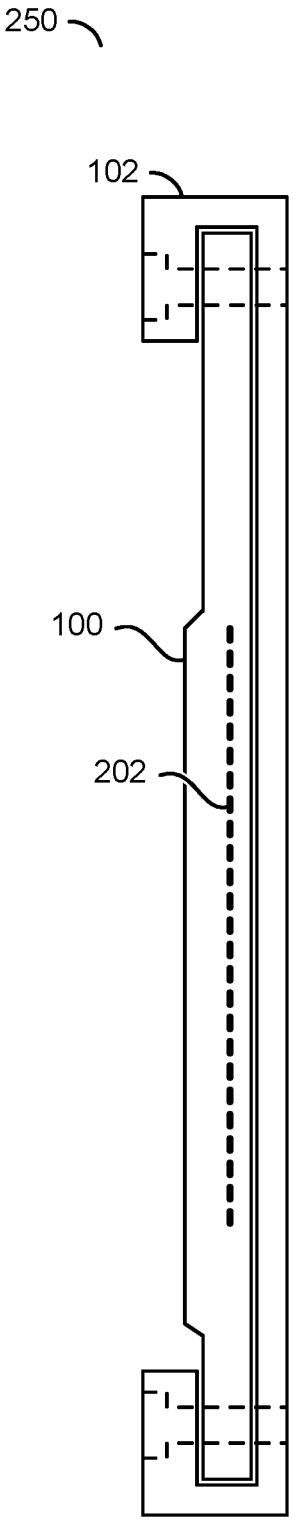
FIG. 6 is a side view of an example license plate embodiment.

Referring to FIG. 6, a side view of an example license plate embodiment 250 is shown. The license plate 100 may be a dielectric license plate (e.g., act as a radome for the antenna circuit 202). For example, the license plate 100 may be a cover for the antenna circuit 202. The antenna circuit 202 may be a part of the license plate 100 (e.g., incorporated into the license plate 100). In some embodiments, antenna circuit 202 is shown on the backside of the license plate 100. In some embodiments, the antenna circuits 202 may be implemented as a separate layer on the backside of the license plate 100.

Figure 7:
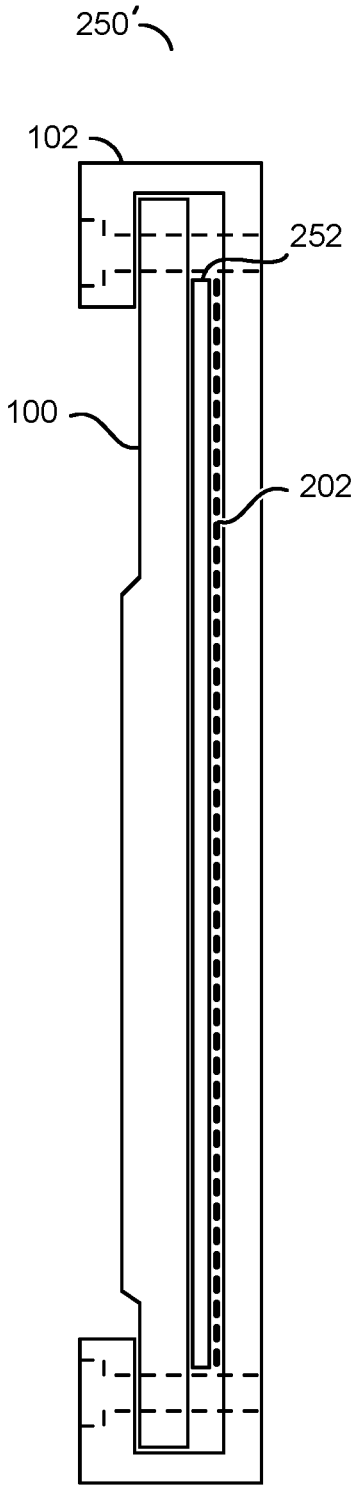
FIG. 7 is a side view of an example license plate embodiment implementing an adhesive attachment.

Referring to FIG. 7, a side view of an example license plate embodiment 250' implementing an adhesive attachment is shown. The license plate 100 may be a dielectric license plate (e.g., act as a radome for the antenna circuit). For example, the license plate 100 may be a cover for the antenna circuit 202. An adhesive 252 is shown attached to the backside of the license plate 100. The antenna circuit 202 is shown attached to the adhesive 252.

The adhesive 252 may allow the antenna circuit 202 to be implemented as a separate layer on the backside of the license plate 100. The adhesive 252 may be applied to the backside of the license plate 100 and the antenna circuit 202 may be secured (e.g., held in place between the license plate 100 and the license plate holder 102) by the adhesive 252. Implementing the adhesive 252 may allow the antenna circuit 202 to be replaced without replacing the entire license plate 100 (e.g., compared to the embodiment 250 where the antenna circuit 202 is integrated in the license plate 100). The type and or amount of the adhesive 252 may be varied according to the design criteria of a particular implementation.

Figure 8:
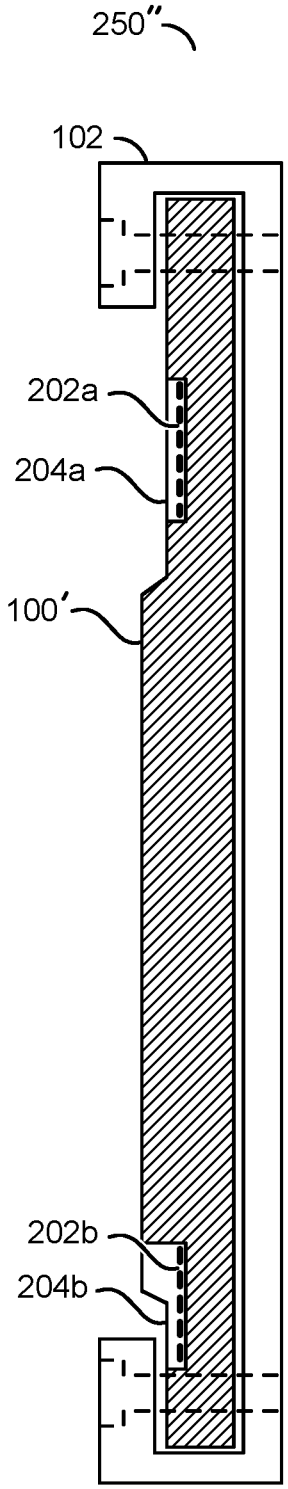
FIG. 8 is a side view of an example license plate embodiment implementing apertures.

Referring to FIG. 8, a side view of an example license plate embodiment 250" implementing apertures 204*a*-204*b* is shown. The license plate 100 may be a metal license plate (e.g., a material used in conventional license plates). For example, the metal material used for the license plate 100 may act as a cover for the antenna circuits 202*a*-202*b* but not act as a radome.

The license plate embodiment 250" is shown having the apertures 204*a*-204*b*. The antenna circuits 202*a*-202*b* are shown in the apertures 204*a*-204*b*. In some embodiments, the apertures 204*a*-204*b* may be an opening (e.g., not filled with any material). In some embodiments, the apertures 204*a*-204*b* may be filled with a dielectric material (e.g., plastic). The apertures 204*a*-204*b* may act as a radome for the antenna circuits 202*a*-202*b*. The license plate 100 may be comprised of a metal material and have the apertures 204*a*-204*b* filled with a dielectric material.

Figure 9:
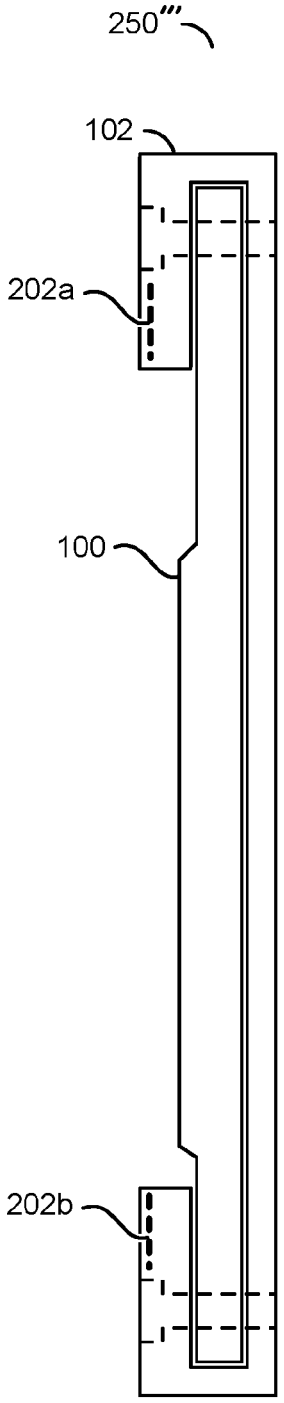
FIG. 9 is a side view of an example license plate holder embodiment.

Referring to FIG. 9, a side view of an example license plate holder embodiment 250'" is shown. In some embodiments, the license plate 100 may be a dielectric license plate (e.g., act as a radome). In some embodiments, the license plate 100 may be a metal material (e.g., a conventional license plate material that does not act as a radome).

The license plate holder 102 may be a dielectric material (e.g., act as a radome for the antenna circuits 202*a*-202*b*). For example, the license plate holder 102 may be a cover for the antenna circuits 202*a*-202*b*. The antenna circuits 202*a*-202*b* are shown integrated in the license plate holder 102. For example, the antenna circuits 202*a*-202*b* may be a part of the license plate holder 102 (e.g., incorporated into the license plate holder 102). Implementing the license plate holder 102 as the radome for the antenna circuits 202*a*-202*b* may allow a retrofit implementation using conventional license plates.

Figure 10:
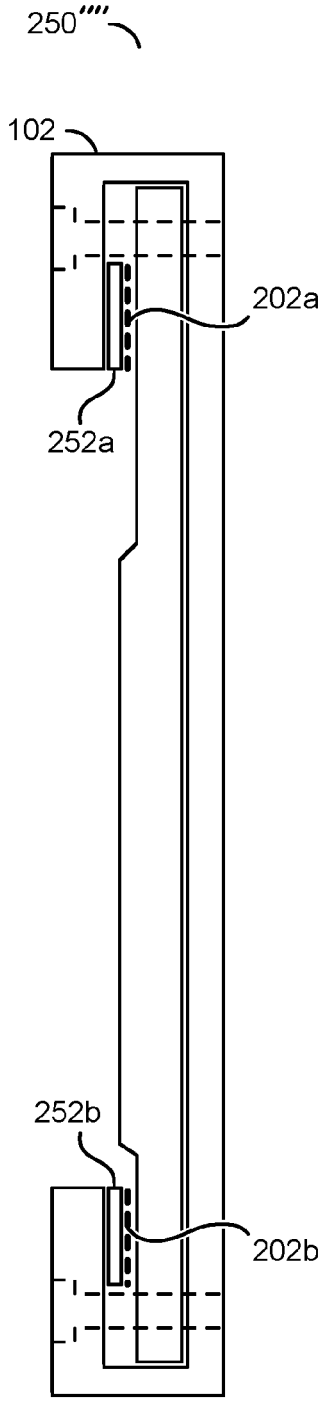
FIG. 10 is a side view of an example license plate holder embodiment implementing an adhesive attachment.

Referring to FIG. 10, a side view of an example license plate holder embodiment 250"" implementing an adhesive attachment is shown. The license plate holder 102 may be a dielectric license plate holder (e.g., act as a radome for the antenna circuit). For example, the license plate holder 102 may be a cover for the antenna circuits 202*a*-202*b*. Adhesives 252*a*-252*b* are shown attached to a backside of the license plate holder 102. The antenna circuits 202*a*-202*b* are shown attached to the adhesives 252*a*-252*b*.

The adhesives 252*a*-252*b* may allow the antenna circuits 202*a*-202*b* to be implemented as a separate layer attached to the license plate holder 102. In an example, the adhesives 252*a*-252*b* may be applied to the backside of the license plate holder 102 and the antenna circuits 202*a*-202*b* may be secured (e.g., held in place between the license plate 100 and the license plate holder 102) by the adhesives 252*a*-252*b*. Implementing the adhesives 252*a*-252*b* may allow the antenna circuits 202*a*-202*b* to be replaced without replacing the entire license plate holder 102 (e.g., compared to the embodiment 250''' where the antenna circuits 202*a*-202*b* are integrated in the license plate holder 102). In the embodiment 250'''', the license plate 100 may be a metal material and/or a dielectric material. The type and/or amount of the adhesives 252*a*-252*b* may be varied according to the design criteria of a particular implementation.

Figure 11:
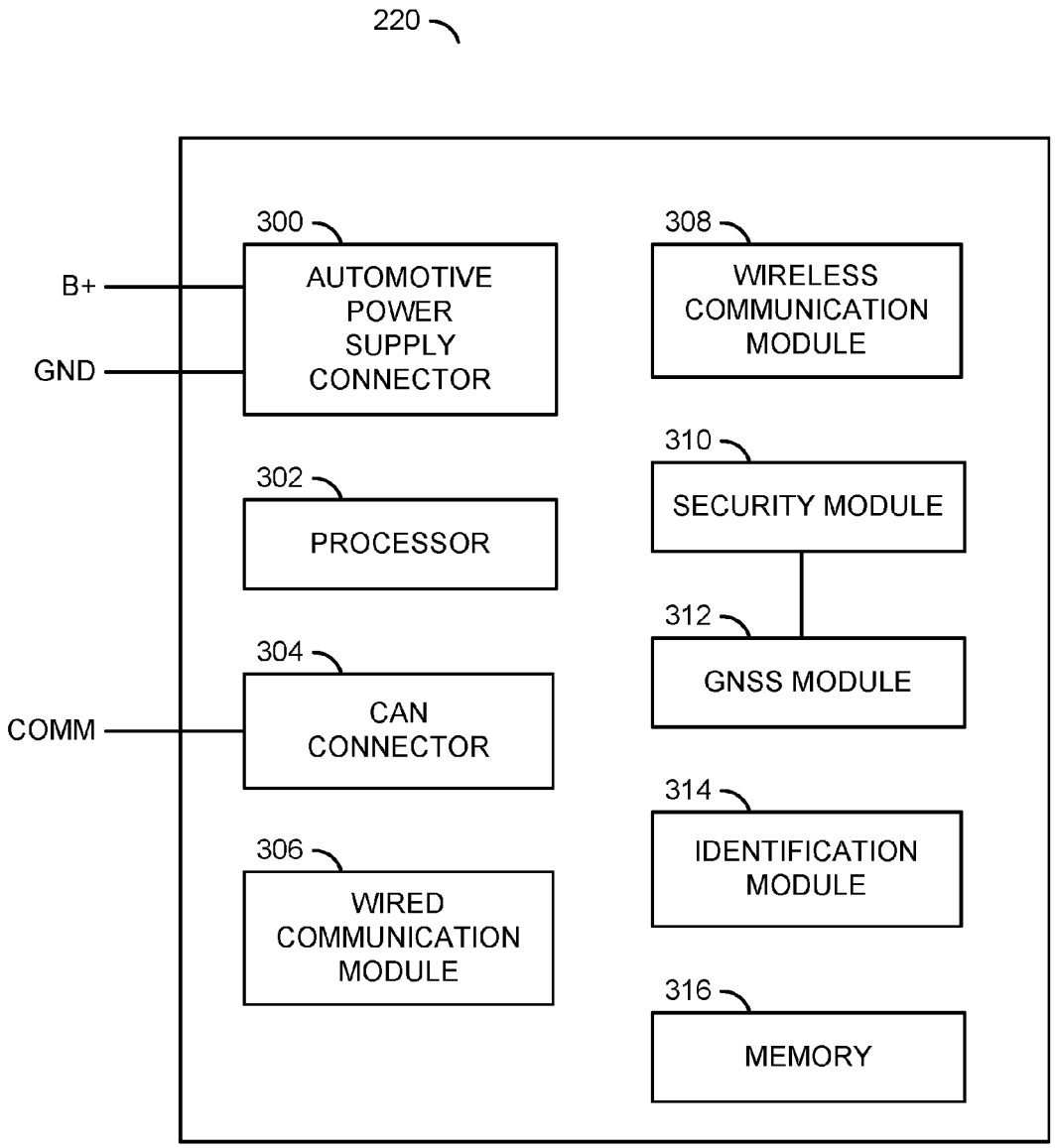
FIG. 11 is a block diagram illustrating an electronic control unit.

Referring to FIG. 11, a block diagram illustrating the electronic control unit (ECU) 220 is shown. The ECU 220 may comprise a block (or circuit) 300, a block (or circuit) 302, a block (or circuit) 304, a block (or circuit) 306, a block (or circuit) 308, a block (or circuit) 310, a block (or circuit) 312, a block (or circuit) 314 and/or a block (or circuit) 316. The circuit 300 may be an automotive power supply connector. The circuit 302 may be a processor. The circuit 304 may be a controller area network (CAN) connector. The circuit 306 may be a wired communication module. The circuit 308 may be a wireless communication module. The circuit 310 may be a security module. The circuit 312 may be a Global Navigation Satellite System (GNSS) module. The circuit 314 may be an identification module. The circuit 316 may be a memory. The ECU 220 is shown receiving a signal (e.g., B+) and a signal (e.g., GND). The ECU 220 is shown sending/receiving a signal (e.g., COMM). The components of the ECU 220 sending and/or receiving the signal B+, the signal GND and/or the signal COMM may be varied according to the design criteria of a particular implementation.

The automotive power supply connector 300 is shown connected to a power supply signal (e.g., B+) and a power supply signal (e.g., GND). The signal B+ and the signal GND may be supplied by the vehicle 52. In an example, the signal B+ and the signal GND may be supplied by the vehicle 52 to supply power to various components of the vehicle 52 (e.g., the ECU 220 may tap into the power supply of the vehicle 52). In some embodiments, the automotive power supply connector 300 may be a DC 6-24V 6-pin connector. In an example, the automotive power supply connector 300 may receive a power signal (e.g., the signal B+). In some embodiments, the automotive power supply connector 300 may send/receive data from a vehicle bus (e.g., the controller area network (CAN) bus). For example, the automotive power supply connector 300 may send/receive the signal COMM. The type of connections implemented by the automotive power supply connector 300 may be varied according to the design criteria of a particular implementation.

The processor 302 may be configured to execute computer-readable instructions. The processor 302 may be configured to execute instructions for an operating system environment (e.g., a Linux operating system). In an example, the processor 302 may be an ARM processor (e.g., an ARM Cortex A9 dual core processor). In some embodiments, the processor 302 may be an AMD processor or an Intel processor. The implementation of the processor 302 may be varied according to the design criteria of a particular implementation.

The CAN connector 304 may be a communication port. For example, the CAN connector 304 may be configured to communicate with an electronic communication bus of the vehicle 52 (e.g., the CAN bus). The CAN connector 304 may send/receive the signal COMM. In some embodiments, the CAN connector 304 may be implemented as part of the automotive power supply connector 300.

The wired connection module 306 may be configured to implement various types of wired connections. In an example, the wired connection module 306 may enable communication between the ECU 220 and various components of the vehicle 52. In another example, the wired connection module 306 may enable communication between the ECU 220 and other devices (e.g., a smartphone, a GPS device, a portable computer, etc.). In some embodiments, many wired connection modules 306 may be implemented to support each type of wired connection protocol. In an example, the wired connection module 306 may implement one or more of a USB port, an Ethernet port, an HDMI port, a PCIe connector, an RS-232 port, etc. The number and/or types of protocols supported by the wired connection module 306 may be varied according to the design criteria of a particular implementation.

The wireless communication module 308 may be configured to enable various wireless communication protocols. In an example, the wireless communication module 308 may enable communication between the ECU 220 and various components of the vehicle 52 (e.g., via the on-board diagnostics (OBD)). In another example, the wireless communication module 308 may enable communication between the ECU 220 and other devices (e.g., a smart phone, a GPS device, a portable computer, etc.). In some embodiments, many wireless communication modules 308 may be implemented to support each type of wireless communication protocol. In an example, the wireless communication module 308 may implement one or more of Wi-Fi, Bluetooth, 3G/LTE, ZigBee, etc. The number and or types of protocols supported by the wireless communication module 308 may be varied according to the design criteria of a particular implementation.

The security module 310 may be configured to enable secure signing and ensure private keys are stored without allowing unauthorized access. The security module 310 may be configured to ensure unauthorized access to various components of the vehicle 52 is prevented. The security module 310 may implement digital signature verification, various types of encryption, and/or digital signing. The type of security implemented may be varied according to the design criteria of a particular implementation.

The identification module 314 may allow the antenna circuits 202*a*-202*b* to transmit identification information for the vehicle 52. The identification module 314 may allow the communication signals transmitted by the antenna circuits 202*a*-202*b* to act as a beacon unique to the vehicle 52. The beacon may be used by other vehicles and/or infrastructure to identify the vehicle 52 and/or associate with the vehicle 52 the data transmitted (e.g., location, speed, acceleration, etc.) by the vehicle 52.

The memory 316 may be configured to store various types of data. For example, the memory 316 may store the computer-readable instructions for the processor 302. In another example, the memory 316 may store data associated with an operating system. The memory 316 may comprise volatile and/or non-volatile memory. For example, the memory 316 may comprise RAM, NAND flash memory and/or NOR flash memory. The type and/or amount of memory implemented may be varied according to the design criteria of a particular implementation.

The ECU 220 may be a small circuit board (e.g., 180 mm×110 mm). In an example, the ECU 220 may be integrated as part of the license plate 100 and/or the license plate holder 102. In another example, the ECU 220 may be mounted to the license plate 100 and/or the license plate holder 102 (e.g., using the adhesive 252). In yet another example, the ECU 220 may be separate from the license plate 100 and/or the license plate holder 102 (e.g., the antenna circuit 202 may be connected to the ECU 220). The dimensions and/or location of the ECU 220 may be varied according to the design criteria of a particular implementation.

Figure 12:
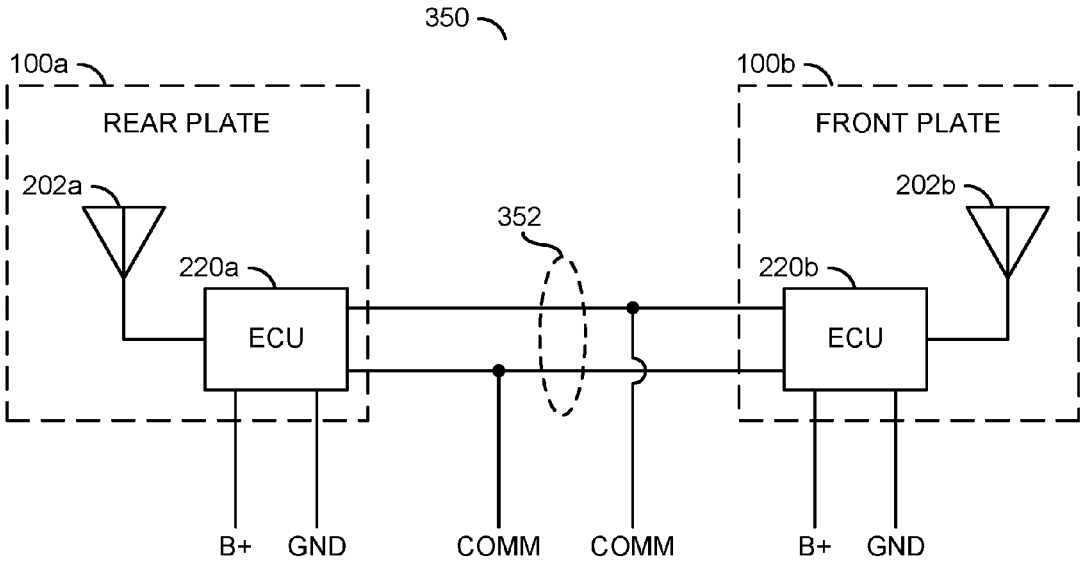
FIG. 12 is a block diagram illustrating a connection between front and rear license plates and a communication bus.

Referring to FIG. 12, a system 350 implementing a connection between the rear license plate 100*a*, the front license plate 100*b* and a communication bus 352 is shown. The rear license plate 100*a* is shown comprising the antenna circuit 202*a* and the ECU 220*a*. The front license plate is shown comprising the antenna circuit 202*b* and the ECU 202*b*. In some embodiments, the antenna circuits 202*a*-202*b* may be integrated as part of the license plates 100*a*-100*b*. In some embodiments, the antenna circuits 202*a*-202*b* may be attached using the adhesive 252. In some embodiments, the ECUs 220*a*-220*b* may be part of the license plates 100*a*-100*b* (e.g., integrated components and/or attached using the adhesive 252 as shown in FIG. 4). In some embodiments, the ECUs 220*a*-220*b* may be connected as an external component to the license plates 100*a*-100*b* (e.g., as shown in FIG. 5). Similarly, the system 350 may implement the license plate holders 102*a* and/or 102*b* in place of the one or more of the license plates 100*a*-100*b*. The implementation of the various components of the system 350 may be varied according to the design criteria of a particular implementation.

Each of the ECUs 220*a*-220*b* are shown connected to the signal B+ and the signal GND. In an example, the ECUs 220*a*-220*b* may receive the signal B+ and the signal GND from a connection to a power source of the vehicle 52. Each of the ECUs 220*a*-220*b* are shown connected to the bus 352. Each of the ECUs 220*a*-220*b* may be configured to transmit and/or receive the signal COMM to/from the bus 352. The bus 352 is shown transmitting the signal COMM. Other signals may be transmitted via the signal COMM.

The signal COMM may be used to transmit various types of vehicle data via the bus 352. The bus 352 may directly or indirectly connect the ECU 220*a* and/or the ECU 220*b*. The bus 352 may implement one or more vehicle communication standards. In some embodiments, the bus 352 may implement a CAN protocol. In some embodiments, the bus 352 may implement a FlexRay protocol. In some embodiments, the bus 352 may implement an Ethernet protocol. The type of protocol implemented by the bus 352 may be varied according to the design criteria of a particular implementation.

The signal COMM may transmit vehicle data, V2V data (e.g., beacon information) and/or V2I data. In an example, the signal COMM may transmit a vehicle speed, a vehicle direction, vehicle sensor information, a timestamp, a unique vehicle identifier, beacon information received from other vehicles, information received from infrastructure, etc. The type of data transmitted via the signal COMM may be varied according to the design criteria of a particular implementation.

Figure 13:
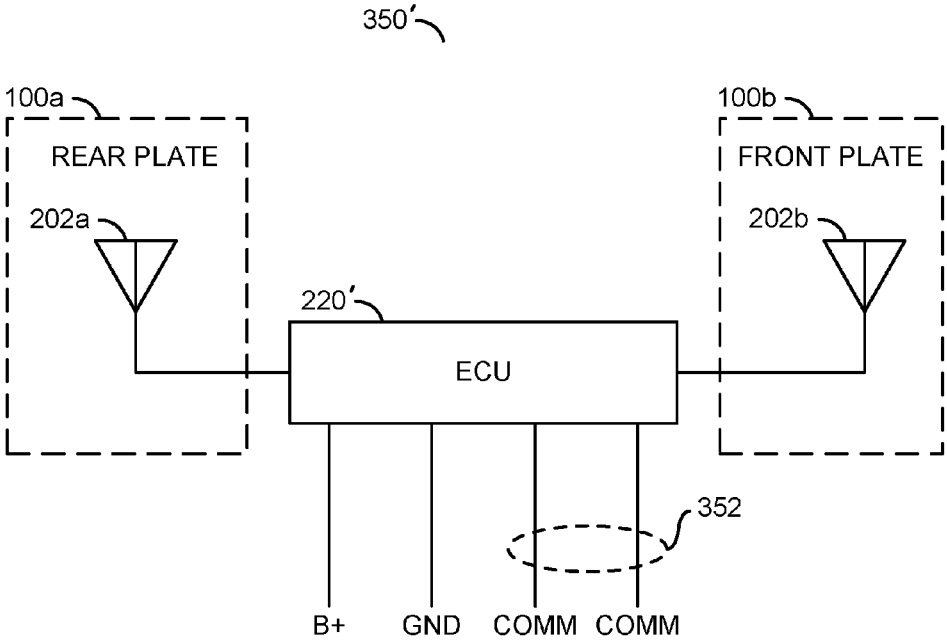
FIG. 13 is a block diagram illustrating an alternate connection between front and rear license plates and a communication bus.

Referring to FIG. 13, a system 350' implementing a connection between the rear license plate 100*a*, the front license 100*b* and the ECU 220' is shown. The rear license plate 100*a* is shown comprising the antenna circuit 202*a*. The front license plate 100*b* is shown comprising the antenna circuit 202*b*. In some embodiments of the system 350', the license plates 100*a*-100*b* may be implemented as the license plate holders 102*a*-102*b*. The implementation of the various components of the system 350' may be varied according to the design criteria of a particular implementation.

The antenna circuits 202*a*-202*b* are shown connected to the ECU 220'. The ECU 220' is shown as a component external to the license plates 100*a*-100*b*. In an example, the ECU 220' may be a component of one of the license plates 100*a*-100*b* and the components of the other one of the license plates 100*a*-100*b* may connect to the ECU 220'.

In the system 350', the antenna circuits 202*a*-202*b* may connect directly or indirectly to the ECU 220'. In an example, the ECU 220' may be a first node connected to the antenna circuits 202*a*-202*b* (e.g., the antenna circuits 202*a*-202*b* may connect to the ECU 220' first, then the ECU 220' may forward data to other components). The ECU 220' may be configured to receive and/or transmit data from one or more sources (e.g., the antenna circuit 220*a*, the antenna circuit 220*b*, the CAN bus, etc.).

The ECU 220' may receive the signal B+ and/or the signal GND. For example, the signal B+ and/or the signal GND may be received from an electrical system of the vehicle 52. The ECU 220' may send/receive the signal(s) COMM. In an example, the signal(s) COMM may be received from one or more sensors of the vehicle 52. In another example, the ECU 220' may receive one signal COMM from the antenna circuit 202*a* and another signal COMM from the antenna circuit 202*b*. The signal(s) COMM may be transmitted to and/or received from the vehicle bus 352.

Figure 14:
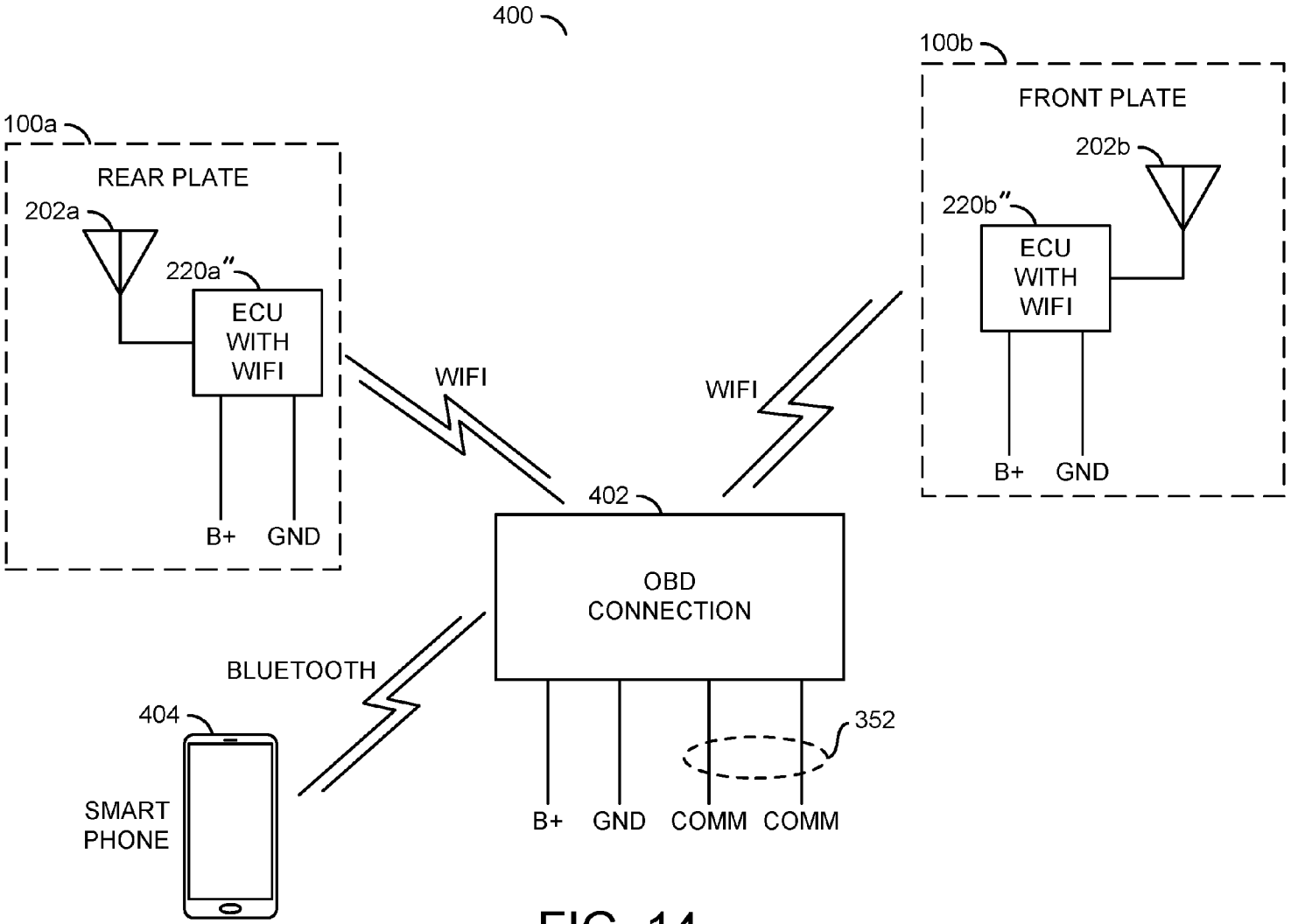
FIG. 14 is a block diagram illustrating a wireless connection embodiment.

Referring to FIG. 14, a system 400 implementing a wireless connection embodiment is shown. The rear license plate 100*a* is shown comprising the antenna circuit 202*a* and the ECU 220*a*". The front license plate 100*b* is shown comprising the antenna circuit 202*b* and the ECU 220*b*". In some embodiments of the system 400, the license plates 100*a*-100*b* may be implemented as the license plate holders 102*a*-102*b*. The implementation of the various components of the system 400 may be varied according to the design criteria of a particular implementation.

The ECUs 220*a*"-220*b*" may receive the signal B+ and/or the signal GND from the vehicle 52. The ECUs 220*a*"-220*b*" are shown implementing a Wi-Fi protocol (e.g., the wireless communication module 308). In some embodiments, the ECUs 220*a*"-220*b*" may implement a Bluetooth connection. In some embodiments, the ECUs 220*a*"-220*b*" may implement a ZigBee connection. The type of wireless connection may be varied according to the design criteria of a particular implementation.

The ECUs 220*a*"-220*b*" are shown wirelessly connected to a block (or circuit) 402. The circuit 402 may be an on-board diagnostics (OBD) connection. In an example, the OBD connection 402 may be an OBD reader device. In another example, the OBD connection 402 may be implemented as a dongle. Generally, the OBD connection 402 may be configured to connect to an OBD port of the vehicle 52 and/or read data from the OBD of the vehicle 52. The type of device implementing the OBD connection 402 may be varied according to the design criteria of a particular implementation.

The OBD connection 402 may receive data (e.g., the signal(s) COMM) from the antennas 202*a*-202*b* via the wireless connection to the ECUs 220*a*"-220*b*". The OBD connection 402 may receive the signal B+ and the signal GND. For example, the OBD connection 402 may receive the signal B+ and the signal GND from a connection to a power supply of the vehicle 52. The OBD connection 402 may send/receive the signal(s) COMM to/from various components of the vehicle 52.

The OBD connection 402 is shown wirelessly connected to a block (or circuit) 404. In some embodiments, the circuit 404 may be a smart phone. In some embodiments, the circuit 404 may be a tablet computing device. In some embodiments, the circuit 404 may be a laptop (or notebook) computer. In an example, the OBD connection 402 may connect to the smart phone 404 via a Bluetooth connection. In another example, the OBD connection 402 may connect to the smart phone 404 via a Wi-Fi connection. The implementation of the circuit 404 and/or the type of wireless connection implemented may be varied according to the design criteria of a particular implementation.

The smart phone 404 may be configured to allow a user to interact with data received from and/or transmitted by the antenna circuits 202*a*-202*b*. In an example, the smart phone 404 may be configured to allow the user to read (e.g., view) data received from the antenna circuits 202*a*-202*b*. In another example, the smart phone 404 may be configured to allow the user to send various commands and/or messages via the antenna circuits 202*a*-202*b*. The types of commands and/or data made available via the smart phone 404 may be varied according to the design criteria of a particular implementation. In an example, the user may enter a command to automatically park the vehicle 52 using the smart phone 404, the ECUs 220*a*"-220*b*" may monitor data (e.g., beacons) received from surrounding vehicles and/or infrastructure to ensure that a parking maneuver can be safely performed, and when the parking maneuver can be safely performed the OBD connection 402 may transmit data to various components of the vehicle 52 to perform the parking maneuver. While the parking maneuver is being performed, the OBD connection 402 may transmit data to the user via the smart phone 404 and/or the OBD connection 402 may transmit data (e.g., velocity data, position data, identification data, etc.) to be sent as a beacon to surrounding vehicles and/or infrastructure to the ECUs 220*a*"-220*b*" to be transmitted via the antenna circuits 202*a*-202*b*.

The apparatus 100 incorporates the antennas 202 into license plates. Generally, license plates 100 are a feature common to all vehicles worldwide. Incorporating the antennas 202 into the license plates 100 enables dedicated short range communication (DSRC) capability with a simple retrofit (e.g., the ability to add the V portion of V2V and/or V2I to the vehicle). Incorporating the antennas 202 into the license plates 100 may be ubiquitous and/or aesthetically un-noticeable.

The license plates 100 may be implemented to allow the vehicle 52 to communicate to other vehicles (e.g., V2V communication). The license plates 100 may be configured to communicate with infrastructure (e.g., V2I communication). The license plates 100 may be configured to provide at least a hemispherical communication coverage for the vehicle 52. One or more of the license plates 100 may be attached to the vehicle 52. For example, one license plate (e.g., the license plate 100*b*) on the front of the vehicle 52 and/or one license plate (e.g., the license plate 100*a*) on the rear of the vehicle 52 may provide a full communication coverage for the vehicle.

The license plate 100 may be comprised of a cover. The cover may be implemented as a dielectric cover. In some embodiments, the dielectric cover may be the material of the license plate 100. The dielectric cover may have one or more apertures 204*a*-204*b*. The cover may be designed to allow communication to/from the antenna circuit 202 while limiting and/or eliminating visibility of the antenna circuit 202 (e.g., act as a radome). The cover may be implemented as a material of the license plate 100. In some embodiments, the cover may be implemented as the license plate holder 102. The antenna circuit 202 may be attached to a backside of the cover (e.g., as a separate layer by using the adhesive 252) and/or be incorporated as part of the cover.

Integrating the antennas 202 into the license plates 100 may allow various automotive OEMs and/or Tier 1 suppliers to be part of the DSRC system that may be integrated into both new vehicles and/or as an aftermarket retrofit. License plates and/or frames are generally ubiquitous to vehicles. Implementing the license plates 100 and/or the license plate holder 102 may allow a DSRC system to be implemented in new vehicles and/or retrofit in old vehicles.

Integrating the antennas 202 into the license plates 100 may be used to implement vehicle-to-vehicle (V2V) and/or vehicle-to-infrastructure (V2I) communication (e.g., allowing vehicles to 'talk' to each other). Information communicated using V2V and/or V2I communication may provide data for driver assistance and/or traffic management such as improved driver safety, autonomous driving, law enforcement, direction/route optimization, etc. V2V communication (e.g., vehicular ad hoc networks) may be implemented using the 5.9 GHz band (e.g., a frequency spectrum set aside by a regulatory body).

Information communicated between vehicles may not exchange and/or record personal information. Generally, data exchanged between vehicles may be basic safety data. In an example, safety data (e.g., the beacon) may be a speed, location and/or direction of a vehicle. The safety data may enable the antennas 202 to transmit a beacon. In an example, data may be exchanged between vehicles (e.g., the beacon may be transmitted) ten times per second (or more). The beacon may provide 360-degree situational awareness around the vehicle 52.

Generally, the beacon may be used to determine if a nearby vehicle could potentially cause a problem. In some embodiments, the beacon transmitted by one car may be used by another car to detect oncoming traffic in a two-lane road passing scenario (e.g., determine if the driver has enough room to pass a vehicle traveling in a same direction and avoid a collision with oncoming traffic while attempting to pass). In some embodiments, the beacon may be used to determine if the driver will potentially collide with another vehicle while making a left hand turn. For example, the driver may receive a notification (e.g., an audible warning from the smart phone 404) if an oncoming vehicle is moving too fast to safely complete a turn (e.g., the vehicles are on a collision course).

The beacon may be used to communicate with vehicles hundreds of yards away to exchange data for driver assistance and/or traffic management. For example, the beacon may be used to allow V2V communication with a vehicle that may not yet be visible to the driver and/or outside a range of on-board vehicle sensors. The beacon may be implemented to enable automatic traffic management (e.g., automated driving) and/or manual traffic management (e.g., providing warnings and/or notifications to the driver of the vehicle 52).

The beacon may be used for driver assistance and/or traffic management such as providing warnings on entering intersections and/or entering/departing highways, obstacle discovery, sudden stop warnings, accident reporting, lane change warnings, managing variable speed limits, communicating with traffic lights (e.g., V2I communication), accommodating emergency vehicles (e.g., ambulances, fire trucks, police cars, etc.), intersection control, automated parking, automated cruise control, safe following distance management, lane keeping assistance, roadside assistance, surveillance, pull-over commands, speed warnings, restricted access warnings, automated toll collection, automated parking payments, map services, searching location-based services (e.g., gas stations, restaurants, recharge stations, restrooms, etc.). In an example, software may be implemented (e.g., using cloud-based computing and/or local processing on the ECU 220) to calculate expected trajectory of the vehicle and relative distances and velocities of surrounding vehicles and information may be sent to the driver about the safest path that can be taken.

The beacon may allow the vehicle to be the node in a network of vehicles and/or infrastructure. The ECU 220 may be configured to execute computer readable instructions to implement an operating system and/or perform particular calculations. The ECU 220 may be configured to implement wireless communication (e.g., Wi-Fi, Bluetooth, ZigBee, etc.). In some embodiments, the ECU 220 may be implemented as a pre-installed component of a vehicle. In some embodiments, the ECU 220 may be implemented as an after-market product. In an example, the ECU 220 may be an after-market product used for a retrofit installation on an older vehicle (e.g., a vehicle that is not capable of performing calculations, does not provide access to particular sensors, is not capable of communication, etc.). The ECU 220 may allow for interoperability between vehicle manufacturers. In an example, the ECU 220 may be implemented according to a specification/agreement set by government, industry and/or academia.

While the invention has been particularly shown and described with reference to the preferred embodiments thereof, it will be understood by those skilled in the art that various changes in form and details may be made without departing from the scope of the invention.

The invention claimed is:

1. An apparatus implemented as a vehicle license plate comprising:

a cover implemented as a dielectric material having one or more apertures; and an antenna circuit configured to provide communication signals to/from said license plate when on a vehicle, wherein (i) said cover is implemented to limit a visibility of said antenna circuit, (ii) an arrangement of said apertures of said cover is configured to allow transmission of said communication signals to/from said antenna circuit, (iii) said antenna circuit provides a range of communication coverage in a particular direction for said vehicle, and (iv) said communication signals implement a beacon to provide data for driver assistance to external users.

2. The apparatus according to claim 1, wherein said cover is implemented as a material of said license plate.

3. The apparatus according to claim 1, wherein said cover is a license plate holder.

4. The apparatus according to claim 3, wherein said beacon is used to determine if a nearby vehicle could potentially cause a problem.

5. The apparatus according to claim 3, wherein said beacon is used by another vehicle to avoid a collision.

6. The apparatus according to claim 3, wherein said data provided by said beacon is used to communicate with a vehicle that is not visible to a driver.

7. The apparatus according to claim 3, wherein said beacon is used to provide warnings to a driver.

8. The apparatus according to claim 1, wherein said antenna circuit is attached to a backside of said cover as a separate layer using an adhesive.

9. The apparatus according to claim 1, wherein said antenna circuit is incorporated as part of said cover.

10. The apparatus according to claim 1, wherein one of said apertures is attached to a rear end of said vehicle and one of said apertures is attached to a front end of said vehicle to provide communication coverage for said vehicle.

11. The apparatus according to claim 1, wherein (a) said apparatus is configured to provide a dedicated short range communication system for said vehicle and (b) said dedicated short range communication system implements vehicle to vehicle communications in a first mode and vehicle to infrastructure communications in a second mode.

12. The apparatus according to claim 1, wherein said apparatus is configured as a retrofit for said vehicle.

13. The apparatus according to claim 1, wherein said dielectric material is a plastic material and said cover is configured as a radome for said antenna circuit.

14. The apparatus according to claim 1, wherein said range of communication coverage comprises a hemispherical communication coverage.

15. An apparatus implemented as a vehicle license plate comprising:

a cover implemented using a dielectric material; and an antenna circuit configured to provide communication signals to/from said license plate when on a vehicle, wherein (i) said cover is implemented to limit a visibility of said antenna circuit, (ii) said dielectric material of said cover is configured to allow transmission of said communication signals to/from said antenna circuit, (iii) said antenna circuit provides a range of communication coverage in a particular direction for said vehicle, and (iv) said communication signals implement a beacon to provide data for driver assistance to external users.

16. The apparatus according to claim 15, wherein said dielectric material is a plastic material.

17. An apparatus implemented as a vehicle license plate comprising:

a cover implemented using one or more apertures filled with a dielectric material; and an antenna circuit configured to provide communication signals to/from said license plate when on a vehicle, wherein (i) said cover is implemented to limit a visibility of said antenna circuit, (ii) said dielectric material of said apertures is implemented to allow transmission of said communication signals to/from said antenna circuit, (iii) said antenna circuit provides a range of communication coverage in a particular direction for said vehicle, and (iv) said communication signals implement a beacon to provide data for driver assistance to external users.

18. The apparatus according to claim 17, wherein a material of said cover is a metal material.

* * * * *